US006330769B1

(12) United States Patent
Manzella et al.

(10) Patent No.: US 6,330,769 B1
(45) **Date of Patent: *Dec. 18, 2001**

(54) SASH MOUNT SYSTEM

(75) Inventors: Francis Manzella, Rockville Centre, NY (US); Harry Riegelman, Arlington, TX (US)

(73) Assignee: Thermo-Roll Window Corp., West Babylon, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/628,601

(22) Filed: Jul. 31, 2000

Related U.S. Application Data

(63) Continuation-in-part of application No. 09/048,438, filed on Mar. 26, 1998, now Pat. No. 6,094,874.

(51) Int. Cl.[7] ..... E06B 3/964

(52) U.S. Cl. ..... 52/204.62; 52/204.51; 52/204.57; 52/204.7; 52/204.6; 49/504; 49/505; 49/DIG. 1; 49/DIG. 2; 49/456; 49/453

(58) Field of Search ..... 52/204.62, 204.51, 52/204.57, 204.7, 204.6; 49/504, 505, DIG. 1, DIG. 2, 456, 453

(56) References Cited

U.S. PATENT DOCUMENTS

| | | | |
|---|---|---|---|
| 1,000,094 | 11/1911 | Klemm . | |
| 3,299,596 | 1/1967 | Neal et al. . | |
| 4,811,532 | 3/1989 | Fratti et al. . | |
| 5,560,149 | 10/1996 | Lafevre . | |
| 5,761,860 | 6/1998 | Koike et al. . | |
| 6,041,552 | 3/2000 | Lindahl . | |
| 6,094,874 * | 8/2000 | Manzella | 52/204.62 |

* cited by examiner

*Primary Examiner*—Carl D. Friedman
*Assistant Examiner*—Dennis L. Dorsey
(74) *Attorney, Agent, or Firm*—Hoffmann & Baron, LLP

(57) ABSTRACT

A frame including a bracket receiver structure and at least one frame-to-sash bracket removably secured to the bracket receiver structure such that the frame-to-sash bracket can be removed or repositioned to enable various sash types to be interchanged within the frame. The frame-to-sash bracket can be a bracket configured to mount a double-hung sash, an inswing sash or an outswing sash within the frame. The various sash types can be installed from either the exterior side or the interior side of the frame.

16 Claims, 15 Drawing Sheets

SASH MOUNT SYSTEM

This application is a Continuation-in-Part of U.S. Application Ser. No. 09/048,438, filed Mar. 26, 1998, now U.S. Pat. No. 6,094,874.

BACKGROUND OF THE INVENTION

1. Field of the Invention

The invention relates to mounting of a sash in a frame, more particularly to a mounting system for a window sash in a window in which the window can be made an inswing, an outswing or a double-hung window, by shifting or replacing a frame-to-sash bracket, and the change can be made from the interior of the building on the window mounted in the building wall; and in which the glazing can be installed in the same opening of a sash in any of a plurality of locations between the interior and exterior face of the sash from the interior of the building while the sash is fixed or swingably mounted in the wall.

2. Description of the Prior Art

A three-window PRIOR ART assembly 20 is shown in FIGS. 1 and 2.

Outswing window sash 24 swings toward the exterior 28 of the building in which assembly 20 is mounted. The building is not shown.

Glazing 30 is held between U-shaped bead bracket 34 and L-shaped bead bracket 38. Bead bracket 38 is an integrally extruded portion of vertical stile 42. Bead bracket 34 is held on vertical stile 42 by bracket receiver structure 48 which is an integrally extruded portion of vertical stile 42.

L-shaped bead bracket 66 is an integrally extruded portion of vertical stile 68. Bead bracket 72 is held on vertical stile 68 by bracket receiver structure 74 which is an integrally extruded portion of vertical stile 68.

When window sash 24 is drawn back into window frame jambs 50 and 52, sash-to-frame closure bracket 56 closes to exterior face 58 of jamb 50, and vertical stile 42 closes to frame-to-sash closure bracket 60.

Sash-to-frame closure bracket 56 is an integrally extruded portion of vertical stile 42. Frame-to-sash closure bracket 60 is an integrally extruded portion of jamb 50.

Glazing 30 cannot be installed in window sash 24 from the interior 32 of the building when the sash is installed in the window frame because insertion of the glazing from the interior or room side against glazing bead brackets 34 and 72 is prevented by L-shaped bead bracket 38 which is permanently attached to stile 42 and by L-shaped bracket 66 which is permanently fixed to vertical stile 68.

Window sash 24 includes vertical stiles 42 and 68. The sash cannot be installed in window frame 76 which includes jambs 50 and 52, from the interior of the building when the window frame is installed in the wall of the building, because insertion of the sash from the interior or room side into frame 76 is prevented by frame-to-sash closure bracket 60 which is permanently attached to window frame jamb 50, frame-to-sash closure bracket 78 which is permanently fixed to window frame jamb 52, sash-to-frame closure bracket 56 which is permanently attached to stile 42, and sash-to-frame closure bracket 77 which is an integrally extruded portion of stile 68 permanently attached thereto.

Window sash 24 can be installed in window frame 76 only from one side of the window when the window is installed in a wall of a building, that is from the exterior of the building.

Glazing 30 can be installed in window sash 24 only from one side of the window when the window is installed in a wall. That is from the exterior 28 of the building, by inserting glazing 30 in between stiles 42 and 68 against permanent beads 38 and 66, and then snapping bead bracket 34 onto stile 42 by bracket receiver structure 48 and snapping bead bracket 72 onto stile 68 by bracket receiver structure 74.

Window frame 104 includes jamb 52 and jamb 106.

Glazing 96 of non-swing window 100 cannot be installed in window frame 104 from the interior 32 of the building when the window frame is installed in the wall of the building because frame-to-glazing bead L-shaped bracket 110 and frame-to-glazing bead L-shaped bracket 112 prevent insertion of glazing 96 from the room or interior 32 side.

Bead bracket 110 is an integrally extruded portion of jamb 52, permanently attached thereto. Bead bracket 112 is an integrally extruded portion of jamb 106, permanently attached thereto.

Glazing 96 can be installed in window frame 104 only from one side of the window frame when the window frame is installed in a building wall. That is from the exterior 28 of the building, by inserting glazing 96 in between jambs 52 and 106, against permanent bead brackets 110 and 112. Then U-shaped bead bracket 118 is snapped onto jamb 52 by bracket receiver structure 120 which is an integrally extruded portion of jamb 52, permanently attached thereto. And U-shaped bead bracket 124 is snapped onto jamb 106 by bracket receiver structure 126 which is an integrally extruded portion of jamb 106, permanently attached thereto.

Inswing window sash 130 of window 132 swings toward the interior 32 of the building. Sash 130 includes stiles 134 and 136. Window frame 140 includes jambs 108 and 144.

Sash 130 cannot be installed in window frame 140 from the exterior 28 of the building when the window frame is installed in the wall of the building. Insertion of sash 130 into frame 140 from the exterior of the building is prevented by stile-to-frame closure brackets 146 and 148.

Bracket 146 is an integrally extruded portion of stile 134, permanently attached thereto. Bracket 148 is an integrally extruded portion of stile 136, permanently attached thereto.

Insertion of sash 130 into frame 140 is also prevented by frame to stile closure brackets 154 and 158.

Bracket 154 is an integrally extruded portion of window jamb 108, permanently attached thereto. Bracket 158 is an integrally extruded portion of jamb window jamb 144, permanently attached thereto.

Glazing 152 of sash 130 cannot be installed in window frame 140 from the exterior of the building when the sash is closed in frame 140 in the building wall. Insertion of glazing 152 into frame 140 to glazing bead brackets 166 and 168 is prevented by L-shaped glazing bead brackets 170 and 172.

Bracket 170 is an integrally extruded portion of stile 134. Bracket 172 is an integrally extruded portion of stile 136.

Sash 130 and glazing 152 can be installed from the interior or room side of the building when window 132 is installed in the wall of the building.

Glazing 152 is installed by inserting the glazing from the room side, between stiles 134 and 136 until the glazing abuts against permanent glazing bead brackets 170 and 172. Then glazing bead bracket 166 is snapped onto bracket receiver structure 176 which is an integrally extruded portion of stile 134. And glazing bead bracket 168 is snapped onto bracket receiver structure 178 which is an integrally extruded portion of stile 136.

If inswing and outswing windows are required in the same opening, two separate windows mulled together would be provided.

SUMMARY OF THE INVENTION

It is one object of the invention to provide one window which accommodates inswing, outswing and double-hung windows.

It is another object of the invention to provide a mounting system for a window sash in which the sash can be installed in the window frame from either the interior or the exterior of the building when the window frame is mounted in a wall of the building.

It is another object of the invention to provide a mounting system for window glazing in which the glazing can be installed in the window sash from either the interior or the exterior of the building when the window frame is mounted in a wall of the building.

It is another object of the invention to provide a mounting system for window glazing in which the glazing can be installed in the window frame from either the interior or the exterior of the building when the window frame is mounted in a wall of the building.

It is another object that the beading which holds the glazing can be installed in an outswing window sash from the interior of the building.

It is another object that the beading on the exterior side and on the interior side of the glazing are interchangeable.

It is another object that a stile of the window includes receiver structures adapted to attach the exterior side and interior side glazing beads to the stile.

It is another object that a jamb of the window includes receiver structures adapted to attach the exterior side and interior side glazing beads to the stile.

It is another object that a jamb of the window includes receiver structures adapted to attach brackets adapted to seal between frame and sash.

It is another object that a swingable window can be made an inswing or an outswing window without turning the window around in a wall.

Other objects and advantages will become apparent from reading the ensuing description of the invention.

A window includes glazing, a rail adjacent to the glazing, and a first bracket receiver integrally extruded portion of the rail configured to attachingly receive a first predetermined window glazing bead bracket adapted to hold the glazing, a first window glazing bead bracket adapted to mate with the first bracket receiver and to hold the glazing, a second bracket receiver integrally extruded portion of the rail configured to attachingly receive a second predetermined window glazing bead bracket adapted to hold the glazing, and a second window glazing bead bracket adapted to mate with the second bracket receiver and to hold the glazing.

In one arrangement the first bracket receiver is configured to attachingly receive the second window glazing bead bracket.

In another arrangement one of the first window glazing bead bracket and the second window glazing bead bracket comprises a decorative curved outer surface.

In another arrangement the first window glazing bead bracket is attachingly mated with the first bracket receiver and comprises a sheath strip that extends over a side of the first window glazing bead bracket and a side of the rail along a substantial portion of the length of the rail.

The first window glazing bead bracket is attached to the rail by the first bracket receiver and is connected to a first side of the glazing, and the second window glazing bead bracket is attached to the rail by the second bracket receiver and is connected to a second side of the glazing.

In another arrangement the window further includes a third bracket receiver integrally extruded portion of the rail configured to attachingly receive a predetermined bracket adapted for closing a space between a sash and a frame.

In a further arrangement, the window includes a bracket receiver structure and at least one frame-to-sash bracket removably secured to the bracket receiver structure such that the frame-to-sash bracket can be removed or repositioned to enable various window types to be interchanged within the window frame. The frame-to-sash bracket can be a bracket configured to mount a double-hung sash, an inswing sash or an outswing sash within the window.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
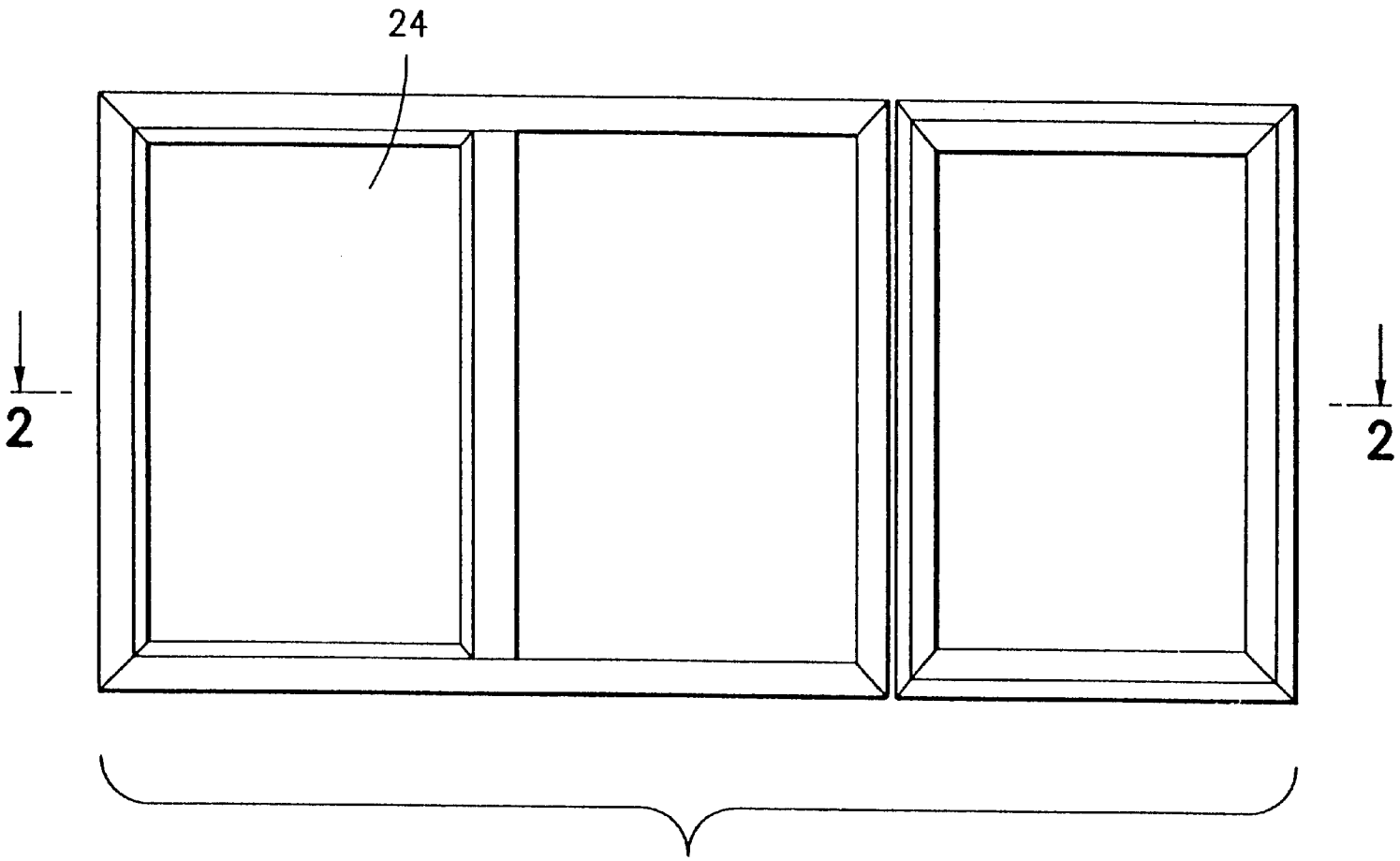
FIG. 1 PRIOR ART
FIG. 1 is an elevation view of the PRIOR ART three window assembly viewed from the interior of the building.
Figures 2, 2A, 2B:
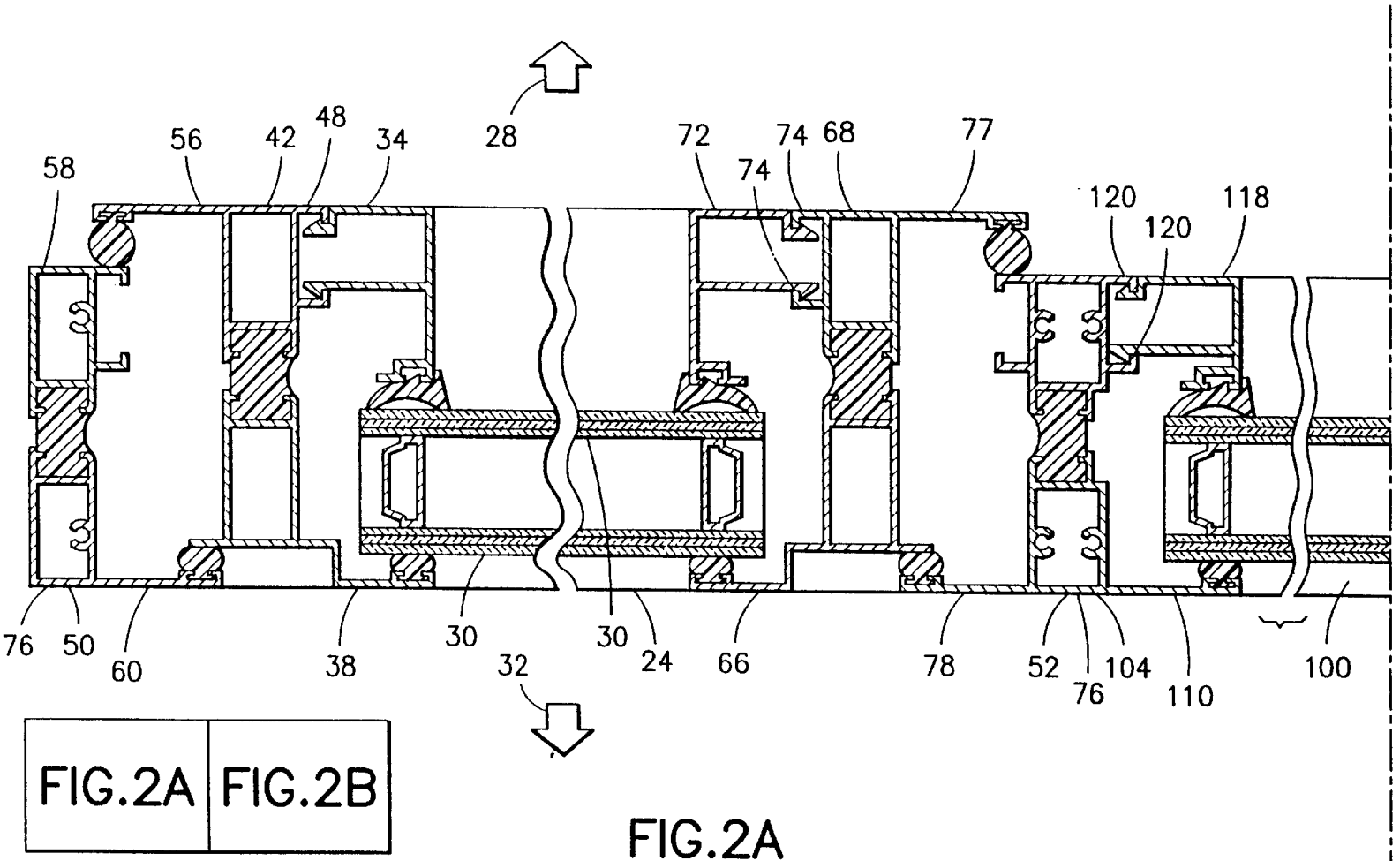
FIG.2 PRIOR ART
FIG. 2 is a schematic cross section view of the PRIOR ART three-window assembly of FIG. 1 viewed along line 2—2. Cross section lines and the bottom sill of the three-window assembly are omitted for clarity of the drawing.
Figure 2B:
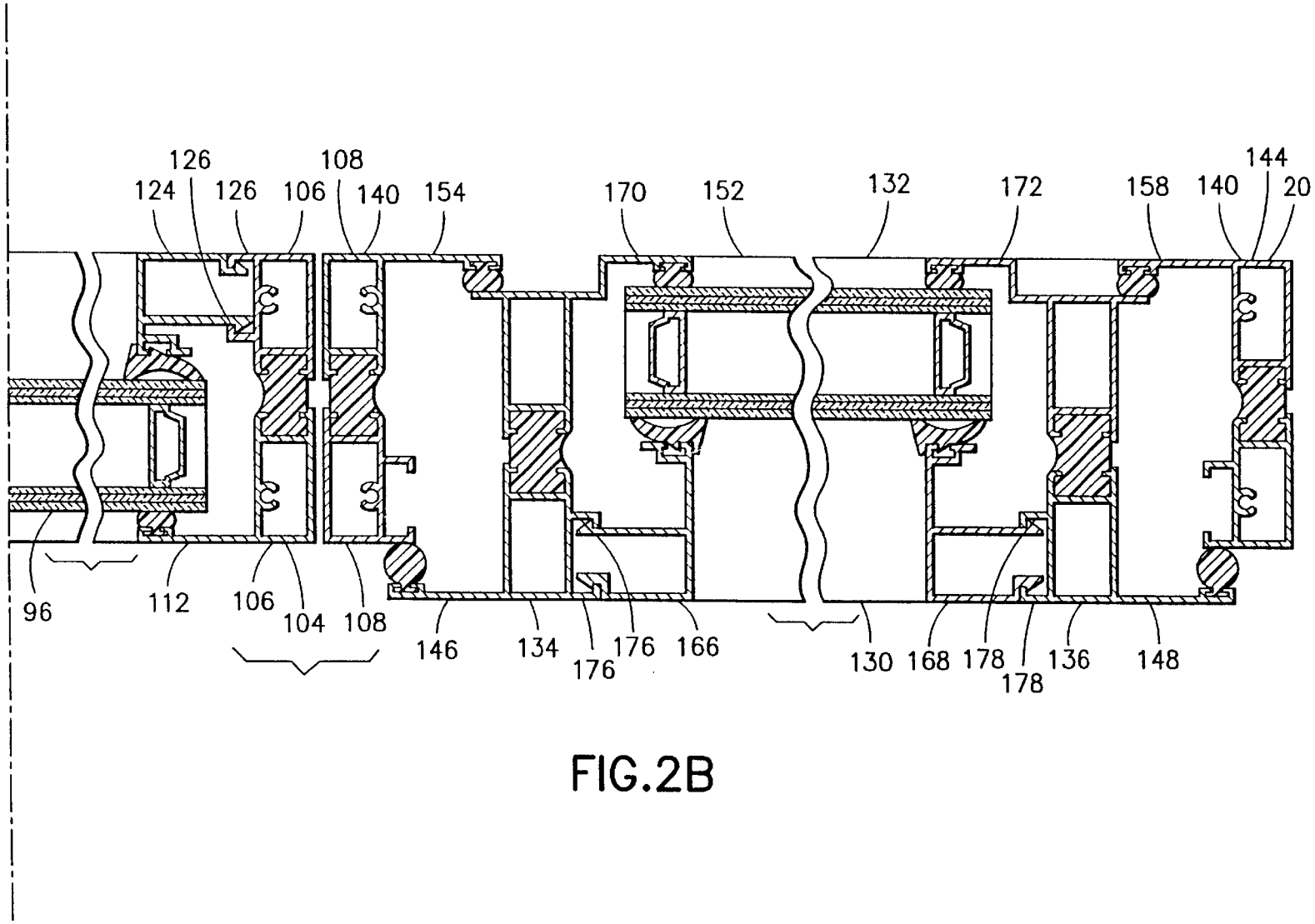

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figures 3, 3A, 3B:
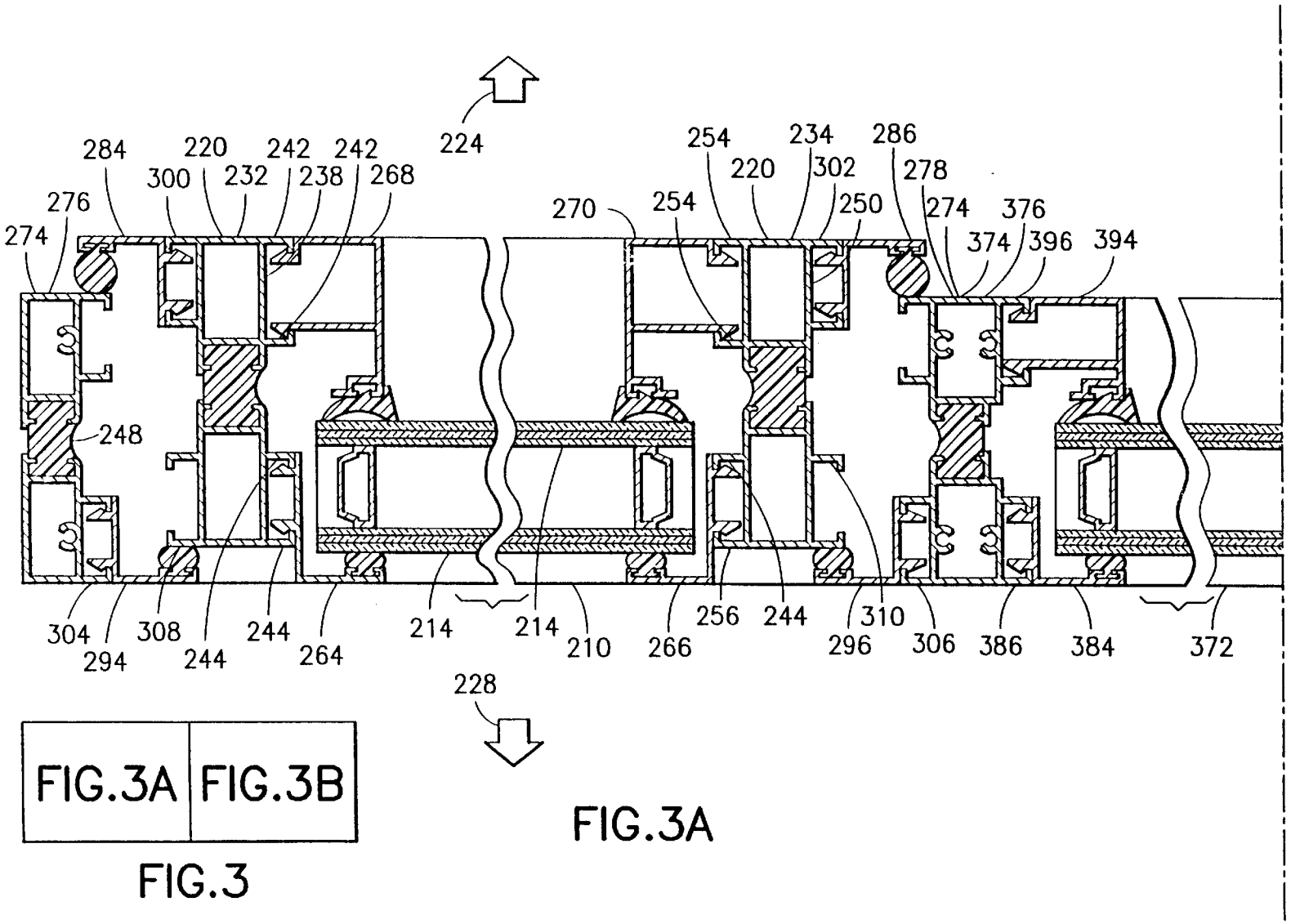
FIG. 3 is a schematic view of a three-window assembly.
Figure 3B:
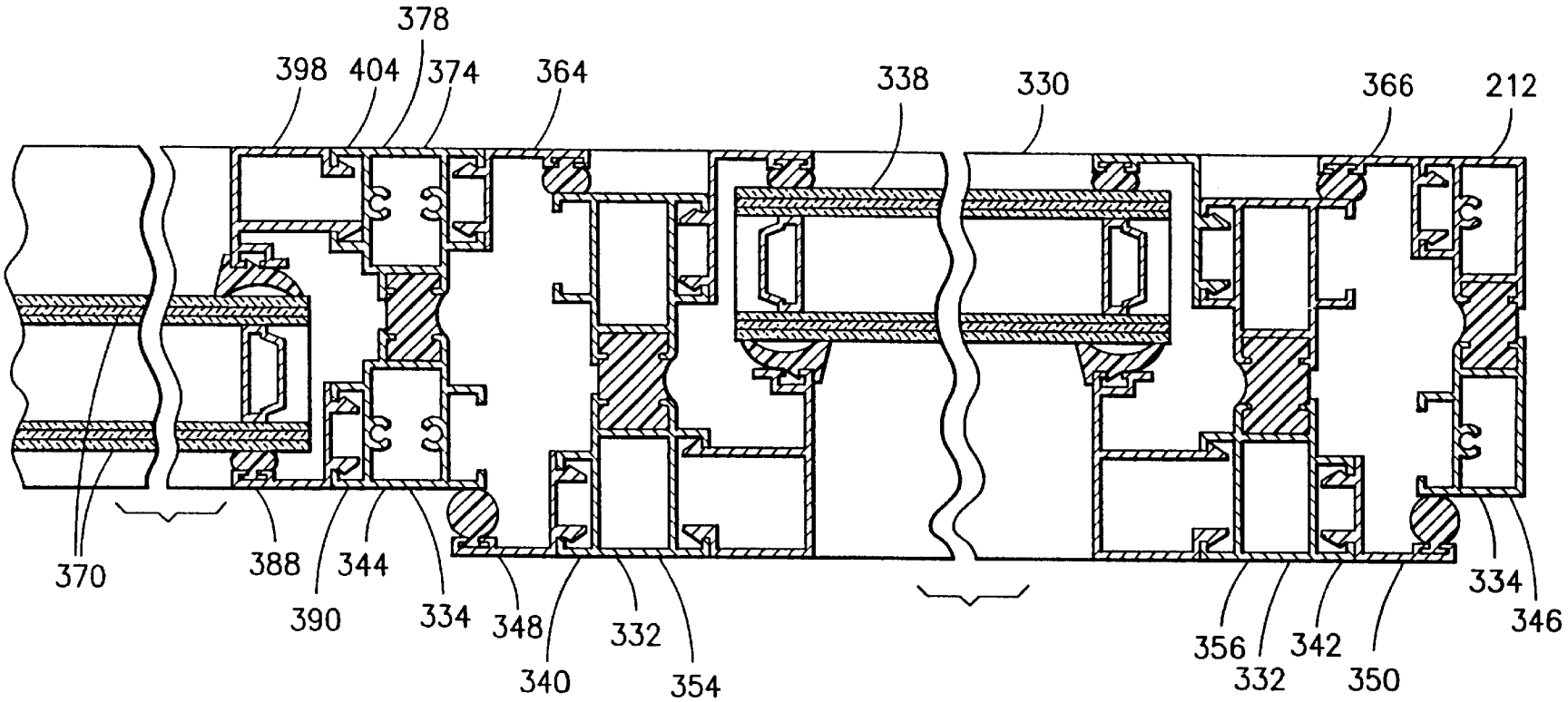

Referring now to FIG. 3, 3-window assembly 212 includes outswing window 210, fixed window 372, and inswing window 330. Conversions in swing of the sash and in position of the glazing within each window of assembly 212 can be made without interchanging or rotating the windows. The changes can be made by working from the safety and convenience of the interior of the building. This will be explained by describing how various conversion elements and portions of each window can be installed working at one's option from either the interior or the exterior of the building while 3-window assembly 212 is permanently mounted in the building wall.

In FIG. 3, glazing 214 of window 210 of 3-window assembly 212 can be installed in sash 220 from two directions. When window assembly 212 is installed in a building wall, glazing 214 can be installed from the exterior 224 of the building or from the interior 228 of the building.

Outswing sash 220 includes stiles 232 and 234. Inward facing side 238 of stile 232 has bracket receiver structures 242 and 244 which are each an integrally extruded portion of stile 232.

The stiles are extruded by any method known, are preferably made of metal, and are insulated by pouring a hardening insulating material in a longitudinal portion of the stile between the exterior and the interior side of the extrusion and cutting a longitudinal slot through the metal extrusion to the insulating material to form a gap in the metal extrusion to reduce the rate of heat transfer by conduction through the stile between the interior side and the exterior side.

Inward facing side 250 of stile 234, the side that is toward the glazing, has bracket receiver structures 254 and 256 which are each an integrally extruded portion of stile 234.

The bracket receiver structures of the invention are configured to attachingly receive predetermined window glazing bead brackets and window closure brackets which are adapted to mate with the bracket receiver structures to make the attachment. Preferably they are also detachable.

When glazing 214 is installed from exterior 224 it is inserted between stiles 232 and 234 until the glazing stops against detachable L-shaped glazing bead bracket 264 which is configured to snap onto bracket receiver structure 244, and the glazing stops against detachable L-shaped glazing bead bracket 266 which is configured to snap onto bracket receiver structure 256.

Then, detachable U-shaped glazing bead bracket 268 which is configured to snap onto bracket receiver structure 242 is snapped thereon, and detachable U-shaped glazing bead bracket 270 which is configured to snap onto bracket receiver structure 242 is snapped thereon.

When glazing 214 is installed from interior 228, it is inserted between stiles 232 and 234 until the glazing stops against U-shaped glazing bead brackets 268 and 270 which are respectively snapped onto bracket receiver structures 242 and 254 for which they are adapted. Then L-shaped glazing bead bracket 264 is snapped onto bracket receiver structure 244 for which it is adapted and L-shaped glazing bead bracket 266 is snapped onto bracket receiver structure 256 for which it is adapted.

The U-shaped glazing beads are preferably detachable. They may be made with sufficient flexibility so that they can be squeezed down in width and slipped out of the bracket receiver structures.

The L-shaped glazing beads are preferably detachable. They may be made with sufficient tolerance to be pryable away from their grip with the bracket receiver structure.

Sash 220 may be installed in window frame 274 from interior 228 or from exterior 224. Window frame 274 includes window frame jambs 276 and 278.

The jambs are extruded by any method known, are preferably made of metal, and are preferably insulated by pouring a hardening insulating material in a longitudinal portion of the jamb between the exterior and the interior side of the extrusion and cutting a longitudinal slot through the metal extrusion to the insulating material to reduce the rate of heat transfer by conduction through the jamb between the interior side and the exterior side.

In installing the sash from the interior, the sash is attached to the frame by a horizontal axis at the bottom of the sash without detachable sash-to-frame closure brackets 284 and 286, and without detachable frame-to-sash closure brackets 294 and 296.

The horizontal axis is positioned at the bottom of the sash according to known engineering practices, in order to provide the swing, and is therefore not shown.

The sash is then rotated outward so that bracket receiver structures 300 and 302 are clear of jambs 276 and 278, and brackets 284 and 286 are snapped onto bracket receiver structures 300 and 302. Brackets 294 and 296 are snapped onto bracket receiver structures 304 and 306.

Bracket receiver structures 304, and 308 are integrally extruded portions of jamb 276 and stile 232 respectively. Bracket receiver structures 306, and 310 are integrally extruded portions of jamb 278 and stile 234 respectively.

Inswing window 330 and sash 332 are of the same construction as window 210 and sash 220. Glazing 338 and sash 332 can be installed in window frame 334 from exterior 224 or from interior 228.

The window is mounted on a horizontal axis positioned on the sash according to known engineering practice to permit tilt of the window.

In installing from the exterior, the window is tilted to the interior so that bracket receiver structures 340 and 342 are clear of jambs 344 and 346. Then detachable L-shaped sash-to-frame brackets 348 and 350 are attached to stiles 354 and 356 respectively. Then detachable L-shaped frame-to-sash brackets 364, 366 are attached to jambs 344, 346 respectively.

Glazing 370 of non-swing window 372 can be installed in window frame 374 from two sides, exterior 224 of the building and interior 228 of the building when window 372 is mounted in a wall of the building.

Window frame 374 includes window jambs 376 and 378.

In installing glazing 370 from exterior 224. Detachable L-shaped frame to glazing bead bracket 384 is attached to jamb 376 by bracket receiver structure 386 which is an integrally extruded portion of jamb 376, and detachable L-shaped frame to glazing bead bracket 388 is attached to jamb 378 by bracket receiver structure 390 which is an integrally extruded portion of jamb 378.

Then glazing 370 is inserted between jambs 376 and 378 until it abuts against brackets 384 and 388.

Then detachable U-shaped glazing bead bracket 394 is attached to jamb 376 by bracket receiver structure 396 which is an integrally extruded portion of jamb 376, and detachable U-shaped glazing bead bracket 398 is attached to jamb 378 by bracket receiver structure 404 which is an integrally extruded portion of jamb 378.

In installing glazing 370 from interior 228, glazing bead brackets 394 and 398 are attached respectively to jambs 376 and 378 by bracket receiver structures 396 and 404.

Then glazing 370 is inserted between jambs 374 and 376 until the glazing abuts glazing bead brackets 394 and 398.

Then bead brackets 384 and 388 are attached respectively to jambs 376 and 378 by bracket receiver structures 386 and 390.

Figure 4:
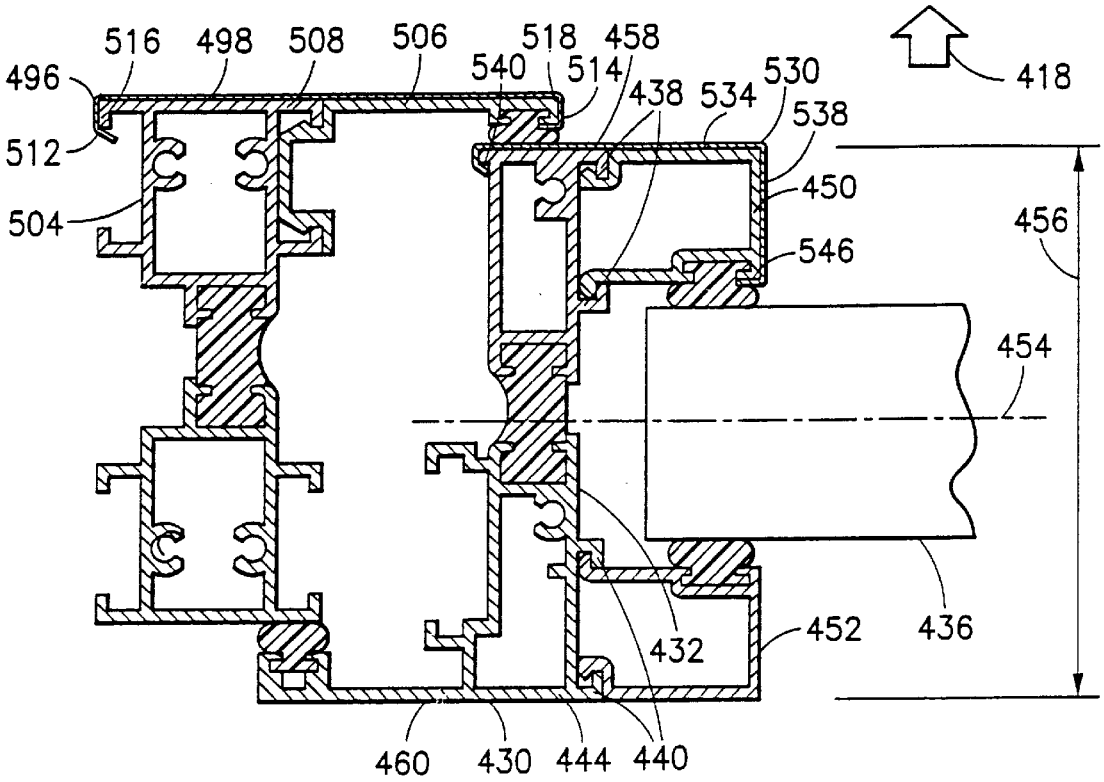
FIG. 4 is a schematic view of a portion of a window assembly.

In FIG. 4 on sash 430 inward facing side 432 which is toward glazing 436, two identical bracket receiver structures 438 and 440 are each an integrally extruded portion of stile 444.

Bracket receiver structures 438 and 440 are configured to attach bead brackets 450 and 452 to stile 444. Bead brackets 450 and 452 are shaped so that glazing 436 is at the middle region 454 of the width 456 from the exterior longitudinal edge 458 to the interior longitudinal edge 460 of the stile.

Figure 5:
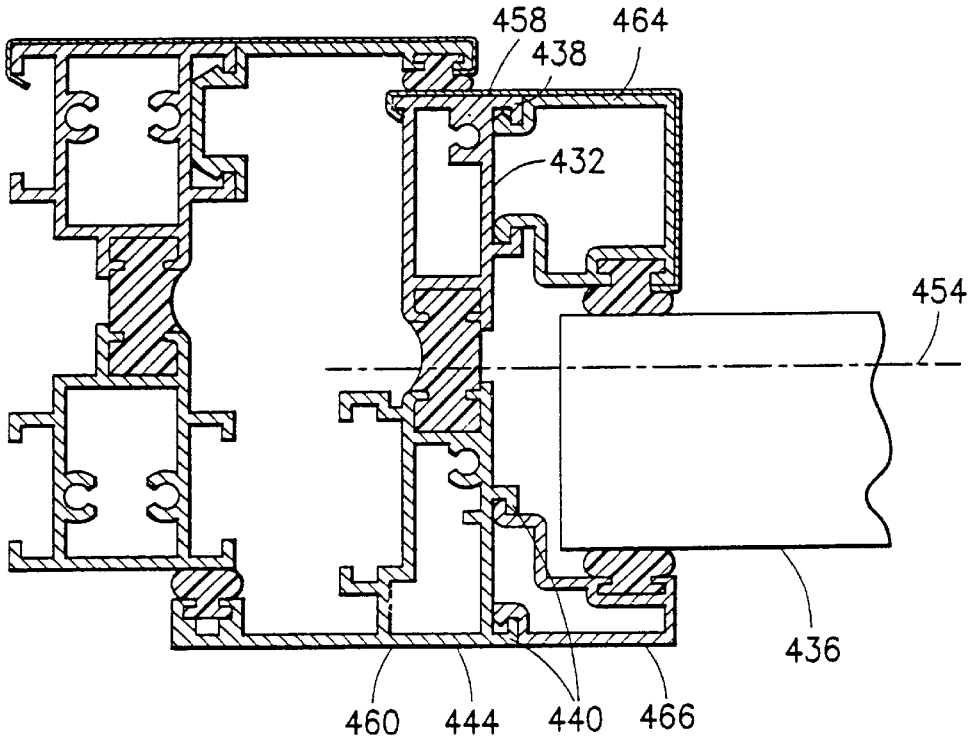
FIG. 5 is a schematic view of the assembly of FIG. 4 with a different attachable bracket.

In FIG. 5, detachable bead brackets 464 and 466 are shaped so that glazing 436 is closer to interior longitudinal edge 460 of the stile than the glazing is to exterior longitudinal edge 458 of the stile.

Bead brackets 464 and 466 can be switched in bracket receiver structures so that glazing 436 is closer to edge 458 than edge 460 by snapping bead bracket 466 in bracket receiver structure 438 and snapping bead bracket 464 in bracket receiver structure 440.

Other sets of detachable bead brackets adapted to attach to one side of stile 444 by bracket receiver structures 438 and 440 may be provided in shapes to fit different thickness glazing and to position the glazing predetermined distances from edges 458 and 460.

Sets of detachable bead brackets adapted to attach to one side of a stile by bracket receiver structures on the side are shown in FIG. 3. See bracket sets 384, 394, and 264, 268.

Figure 6:
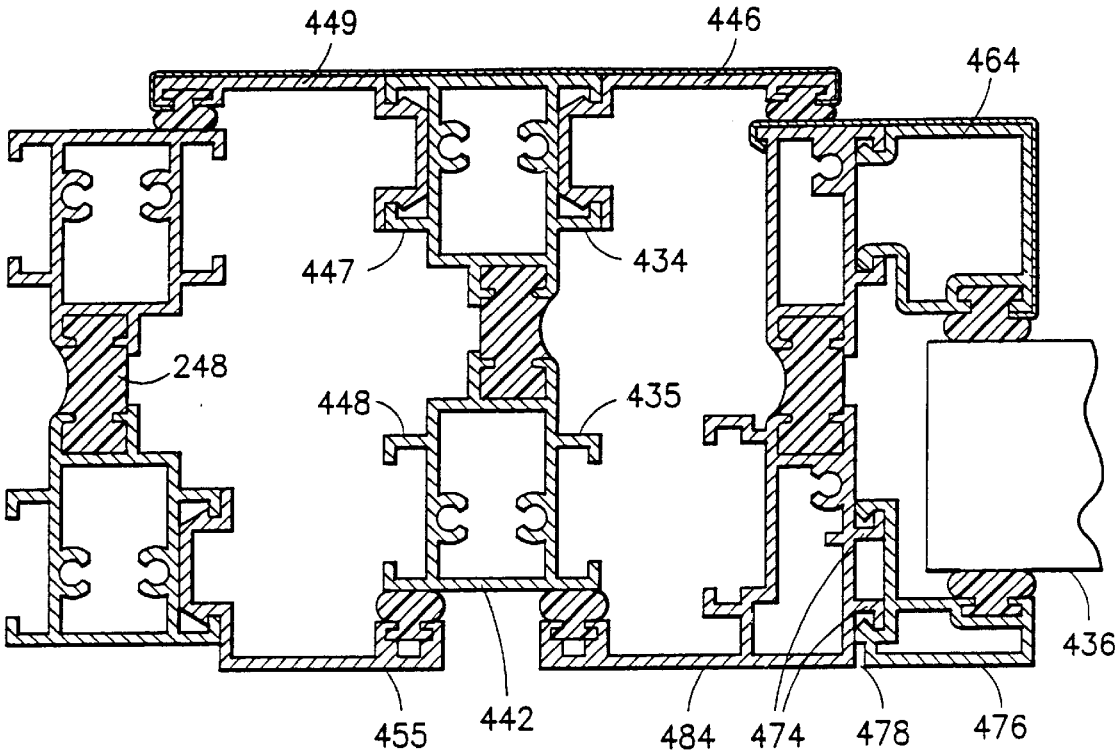
FIG. 6 is a schematic view of a portion of a window assembly.

FIG. 6 shows bracket receiver structure 474 of the invention configured to attachingly receive predetermined window glazing bead bracket 476 which is adapted to mate with the bracket receiver structure to make the attachment. Preferably bead bracket 476 is detachable. Slot 478 permits insertion of a screw driver between bracket 476 and stile 484 to aid in removal of the bracket from the bracket receiver structure.

Bracket receiver structures 434 and 435 of jamb 442 are adapted to attachingly receive frame-to-stile closure bracket 446.

Bracket receiver structures 447 and 448 are adapted to attachingly receive frame-to-stile closure bracket 449.

Frame-to-stile closure brackets 446, 449, and 455 are each adapted to attachingly fit bracket receiver structures 434, 435, 447, and 448.

Figure 7:
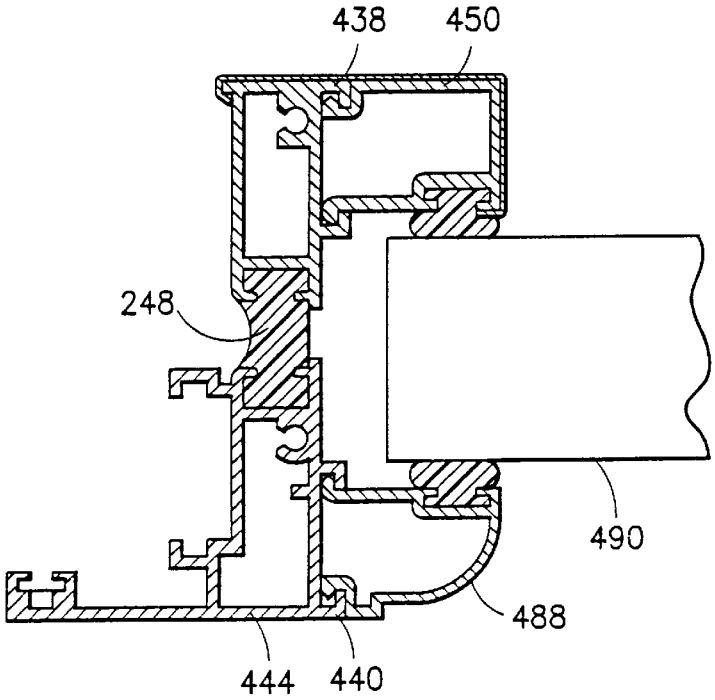
FIG. 7 is a schematic view of the assembly of FIG. 4 with different attachable brackets.

FIG. 7 shows curved-profile bead bracket 488 attached to stile 444 by bracket receiver structure 440, holding glazing 490 with bead bracket 450. Bead bracket 488 is an extrusion shown in cross section.

Figure 8:
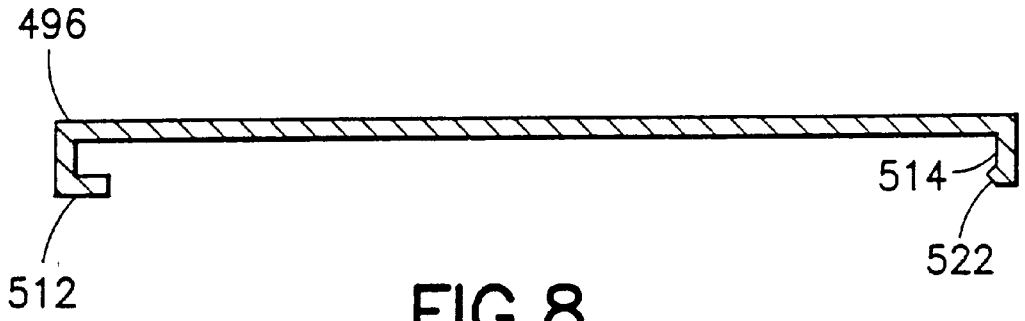
FIG. 8 is a cross section view of a strip of the assembly of FIG. 4.
Figure 9:
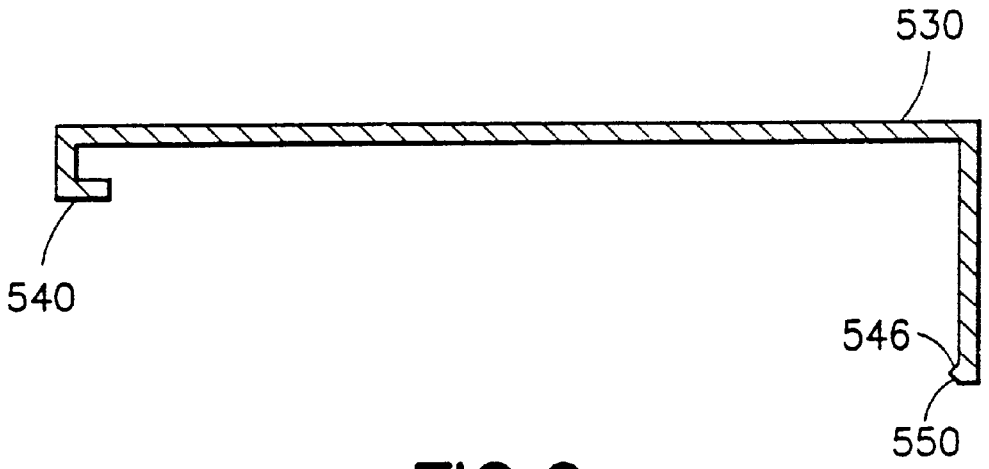
FIG. 9 is a cross section view of a strip of the assembly of FIG. 4.

In FIGS. 4, 8 and 9, strip 496 is formed to closely fit and cover the longitudinal exterior edge 498 of window frame jamb 504 and the adjacent parallel exterior longitudinal side of frame-to-stile closure bracket 506 which is attached to jamb 504 by bracket receiver structure 508. Strip 496 is preferably painted on the exterior side and presents a uniform appearance. The strip is preferably roll formed from 6063-T5 aluminum or 1100-H14 aluminum, about 0.020 inches thick. It is formed to grip the combined jamb and bracket by portions 512 and 514 of the strip that fold back under strip 496. Strip 496 can be mounted on combined jamb and bracket by sliding on the extruded jamb and bracket from one end. Strip 496 can also be mounted by snapping it over the combined jamb and bracket by catching it on jamb 504 longitudinal outward edge 516 by portion 512, and swinging it down until ramped portion 522 snaps past longitudinal inward edge 518 of frame-to-stile closure bracket 506.

Strip 530 is formed to closely fit and cover the exterior longitudinal edge 458 of stile 444 extrusion and the exterior longitudinal side 534 and inward side 538 of bead bracket 450 which is attached to stile 444 by bracket receiver structure 438. It is attached by catching turned-under portion 540 on the stile and catching turned under portion 546 on bead bracket 450 by sliding ramped portion 550 down and past inward side 538 of bead bracket 450.

Figure 10:
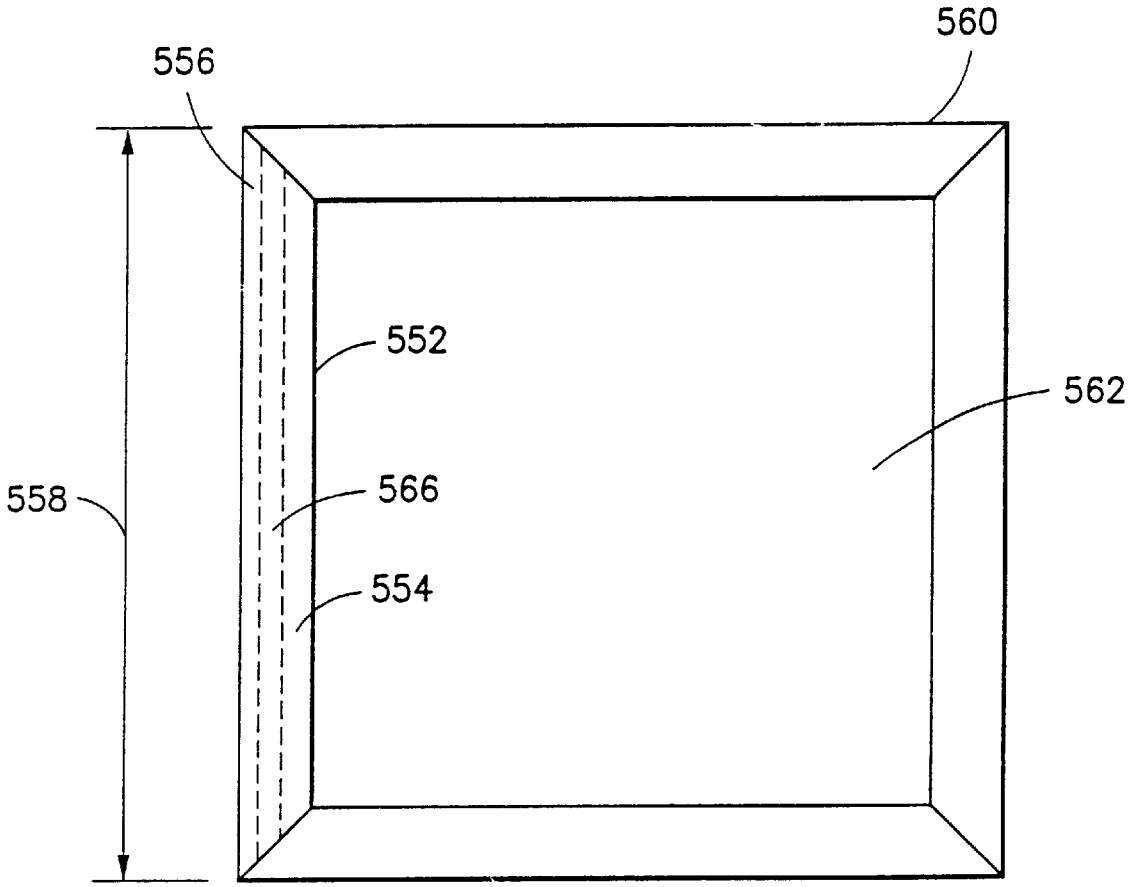
FIG. 10 is an elevation exterior view of a window.

FIG. 10 shows strip 552 extending over bead bracket 554 and stile 556 over a substantial portion of the length 558 of stile 556 which is adjacent to glazing 562 of window 560. Bead bracket 554 is attached to stile 556 by bracket receiver structure 566 which is an integrally extruded portion of stile 556.

Figure 11A:
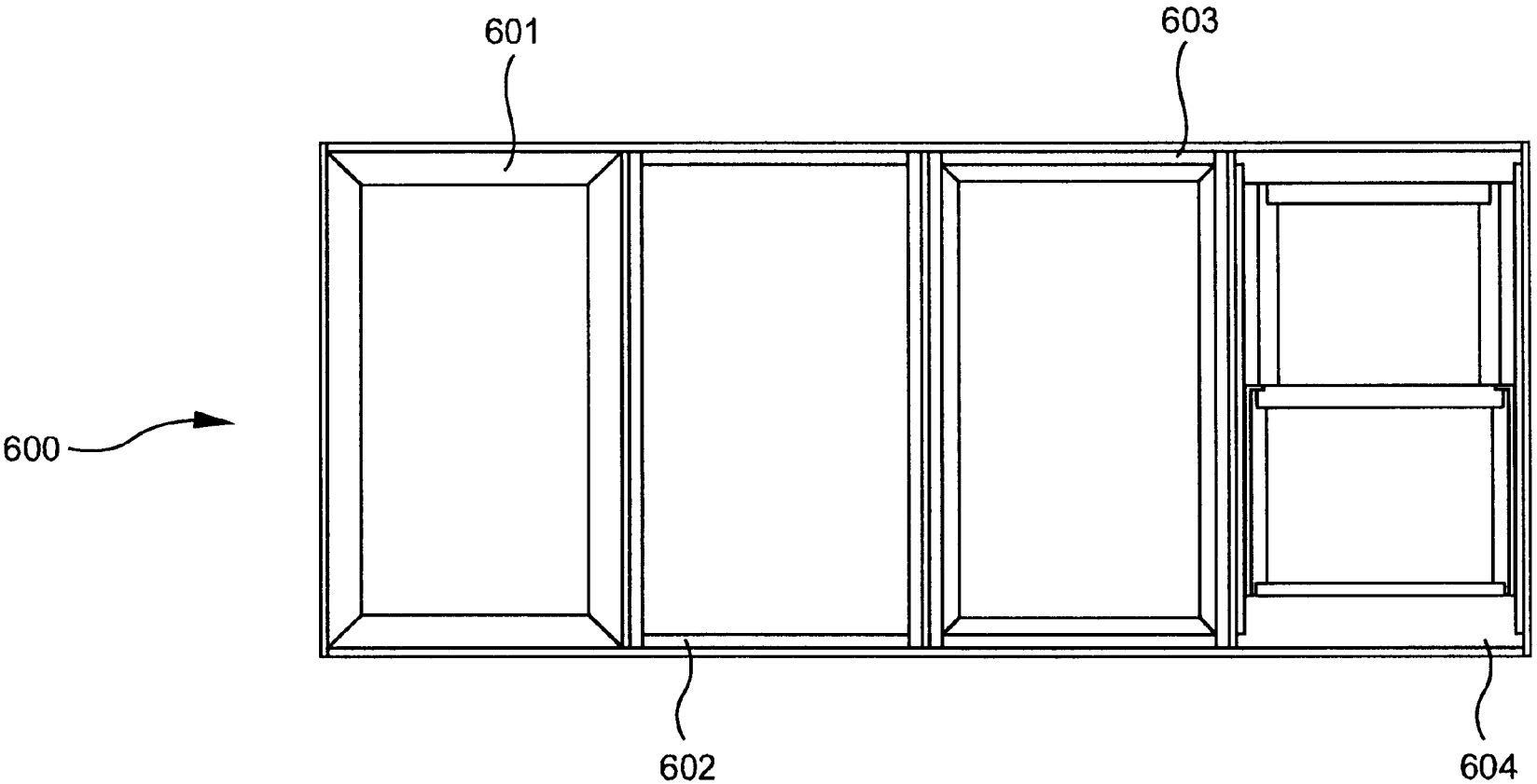
FIG. 11A is an interior elevation view of a further embodiment of the window frame of the present invention.
Figure 11B:
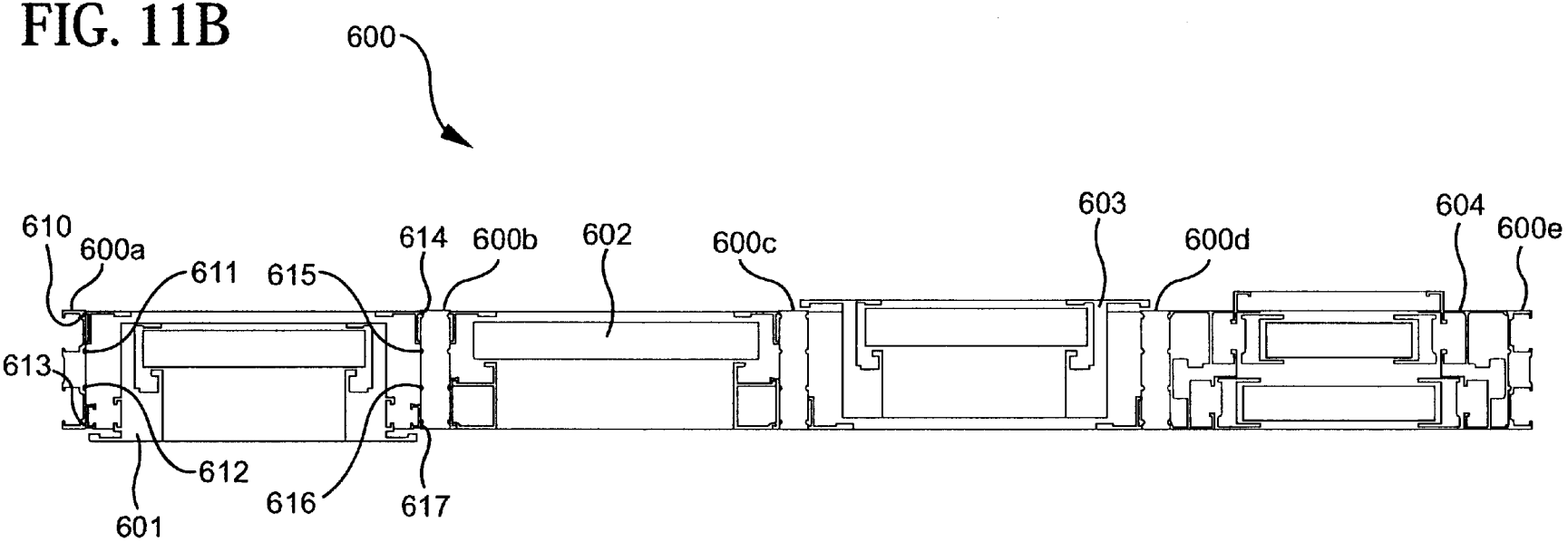
FIG. 11B is cross-section view of the window frame of FIG. 11A along line A–E.

Referring now to FIGS. 11A and 11B, a further embodiment of the frame of the present invention is shown. In this embodiment, the frame 600 is shown as a 4-window arrangement (i.e., an inswing window 601, a fixed window 602, an outswing window 603, and a double-hung window 604). Although frame 600 is shown as a 4-window structure, it will be evident from the following description that the present frame can be a single window arrangement.

Further, it will be evident from the following detailed description that the present frame can be adapted for use as a door frame by sizing the jamb portions for use with a door and providing frame-to-sash brackets which are adapted to allow the door sash to move between an open and a closed position. It is contemplated that the frame can be used to interchange inswing door sashes, outswing door sashes, sliding door sashes, tilt-and-turn door sashes, fixed side-lite door sashes, or the like, without the need to replace the entire frame structure. Doors of this type are well known in the art and can be found in the Thermo Roll Window Corp. "Door Pak" Catalog, the contents of which are incorporated herein by reference. The use of the present frame with interchangeable doors will enable one, for example, to swap a sliding glass door for an outswing French door without the need to replace the frame for the door.

As shown in FIG. 11B, frame 600 includes opposing jamb sections (600*a*–600*b*, 600*b*–600*c*, 600*c*–600*d*, and 600*d*–600*e*) which define an opening. Each opposing jamb section includes a bracket receiver structure and a frame-to-sash bracket removably secured to the bracket receiver structure such that the frame-to-sash bracket can be removed and either repositioned or replaced with an entirely different frame-to-sash bracket. This interchangeability of the frame-to-sash bracket enables various sash types to be interchanged within the frame 600. Further, the frame-to-sash bracket allows for movement of the sash within the opening. For example, if the sash is an outswing window sash, then the frame-to-sash bracket will allow the sash to move out of the frame; if the sash is a double-hung window sash, then the frame-to-sash bracket will allow the two sashes of the double-hung window to slide up and down within the bracket.

Unlike the embodiment described above wherein the four bracket receiver structures are C-shaped, each of the bracket receiver structures shown in FIG. 11B include a pair of parallel grooves which preferably run the entire length of the jamb. In other words, the first bracket receiver structure includes a pair of parallel grooves 610, 611; the second bracket receiver structure includes grooves 612, 613; the third bracket receiver structure, which is positioned opposite the first bracket receiver structure, includes grooves 614, 615; and the fourth bracket receiver structure, which is positioned opposite the second bracket receiver structure, includes grooves 616, 617. Preferably, each groove runs the entire opening of the window defined by the jambs (i.e., the grooves extend along the top and bottom, as well as each side jamb).

Figure 12:
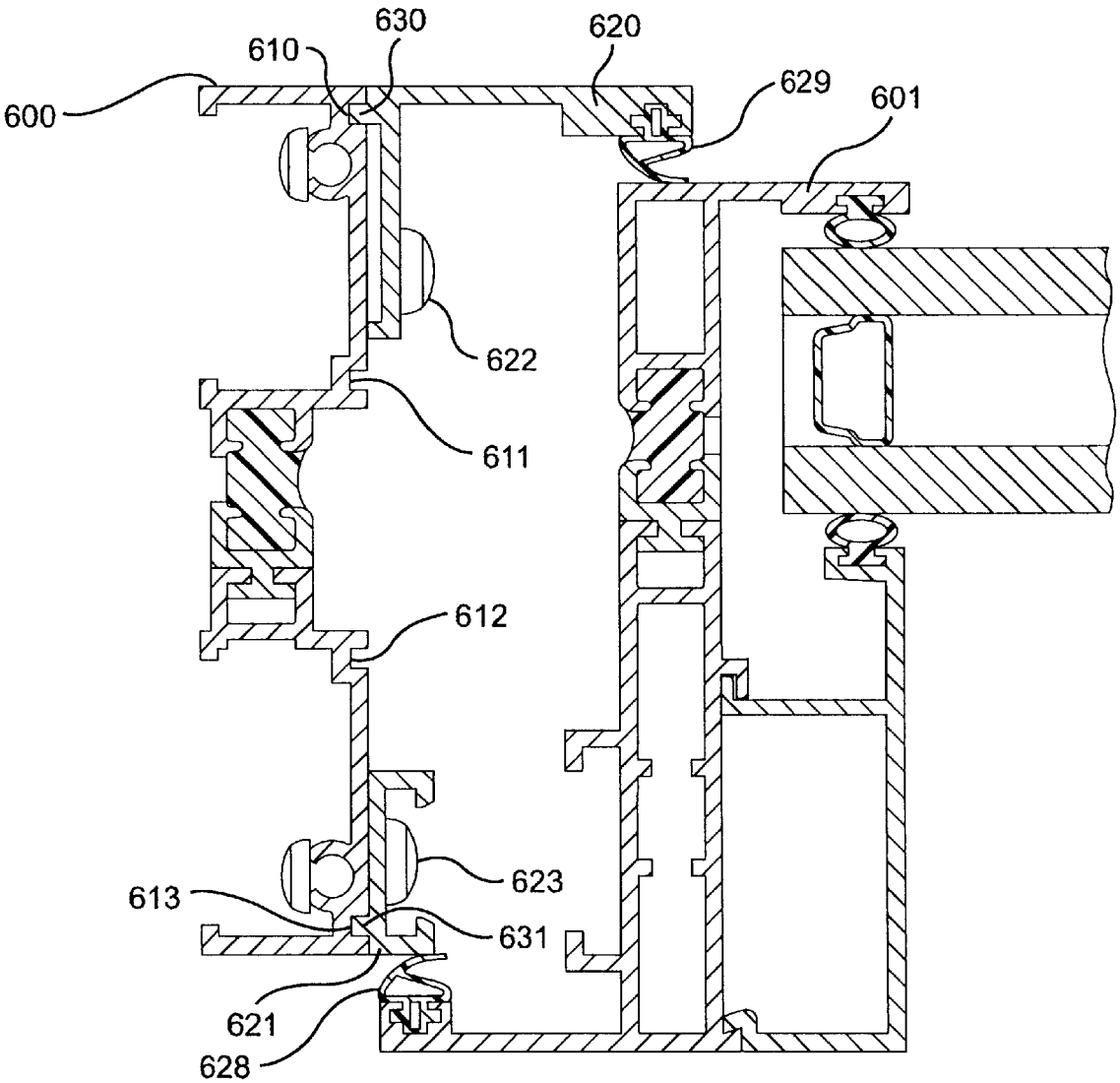
FIG. 12 is a cross-section view along line A of FIG. 11.

Depending upon the type of sash to be placed within the opening defined by the frame, the frame-to-sash bracket arrangement will vary accordingly. For example, and as shown in FIG. 12, when an inswing window sash 601 is mounted within the frame, the frame-to-sash brackets used include an L-shaped bracket 620 and an interior seal bracket 621. As will be evident to one skilled in the art, FIG. 12 shows only the left side of the frame/bracket arrangement, the right side being a mirror image thereof. Therefore, the frame-to-sash bracket described in FIG. 12 includes a first frame-to-sash bracket 620 on the left side, and a mirror image second frame-to-sash bracket (not shown) on the right side. Both frame-to-sash brackets are removably secured within opposed bracket receiver structures, as more clearly seen with reference to FIG. 11B.

The L-shaped bracket 620 is removably secured within one or more grooves 610, 611 of the first bracket receiver structure by a corresponding rib 630 on the bracket, the right side being a mirror image. Further, with the embodiment shown, an interior seal bracket 621 is releasably secured within one or more grooves 612, 613 of the second bracket receiver structure by a corresponding rib 631. However, the interior seal bracket 621 may be omitted if the sash 601 is dimensioned to seat against the frame 600. The frame-to-sash brackets may be releasably secured in their respective bracket receiver structures by a screw 622, 623 or any other means which will enable the frame-to-sash brackets to be removed and replaced or repositioned within a different bracket receiver structure. This positioning of the frame-to-sash brackets will allow movement of the inswing sash away from the window frame, will enable sealing of the sash against gasket 629 of the L-shaped bracket and sealing of the sash gasket 628 against interior seal bracket 621.

Figure 13:
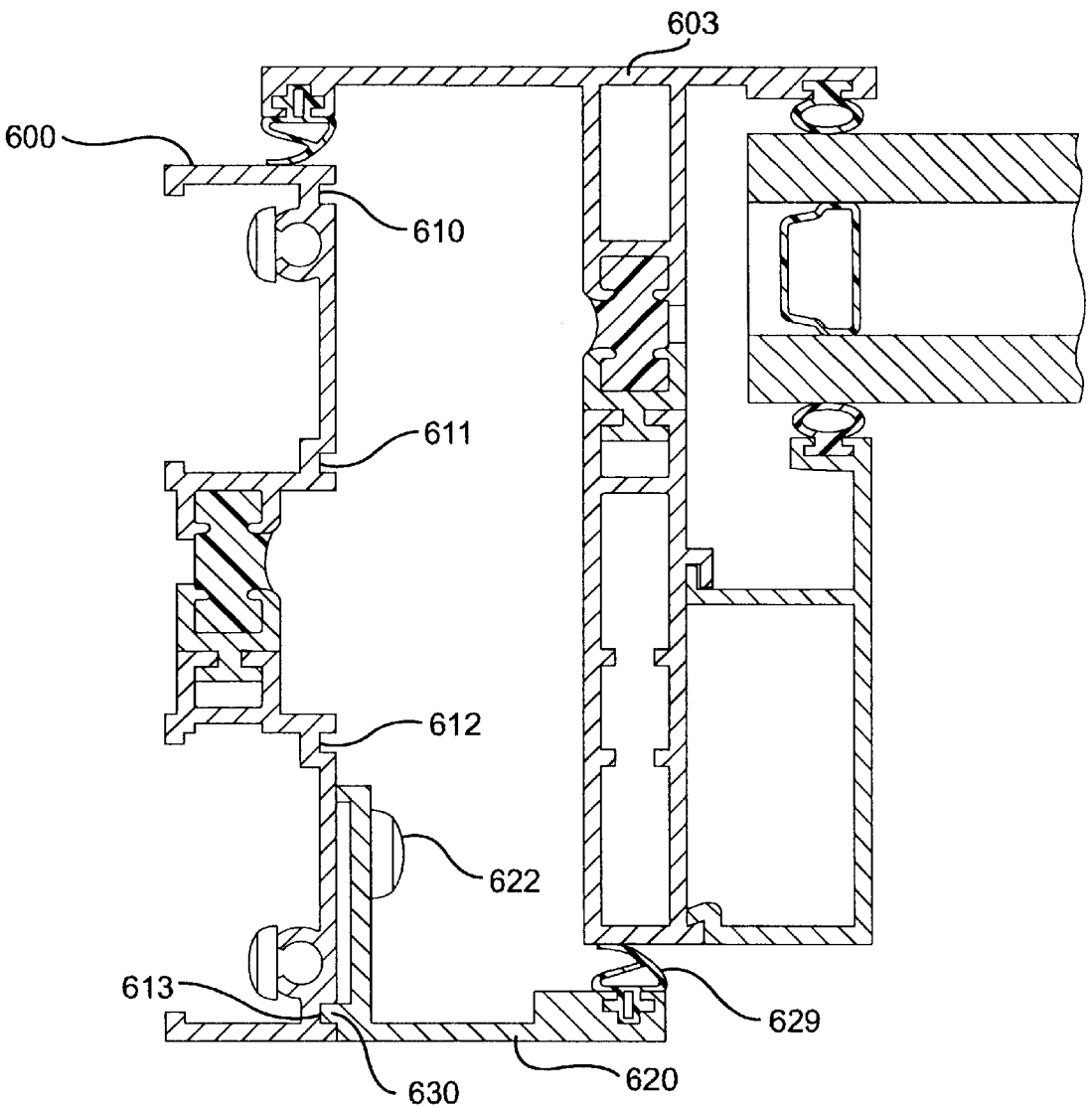
FIG. 13 is a cross-section view along line C of FIG. 11.

As shown in FIG. 13, the frame 600 may be modified to accommodate an outswing window sash 603. In order to modify the frame opening to accommodate an outswing window sash 603, as opposed to the inswing window sash previously described, the L-shaped frame-to-sash bracket 620 is removed from the first bracket receiver structure and repositioned in the second bracket receiver structure by aligning the rib 630 within the second bracket receiver structure groove 613 and securing the bracket by the screw 622. As will be evident to one skilled in the art, the right half of the frame/bracket arrangement will have the L-shaped frame-to-sash bracket removed from the third bracket receiver structure and repositioned in the fourth bracket receiver structure. This repositioning of the L-shaped brackets will allow the movement of the outswing window sash away from the frame, and will also enable the sealing of the sash against the gasket 629 of the L-shaped brackets when the outswing window sash 603 is in the closed position.

Figure 14:
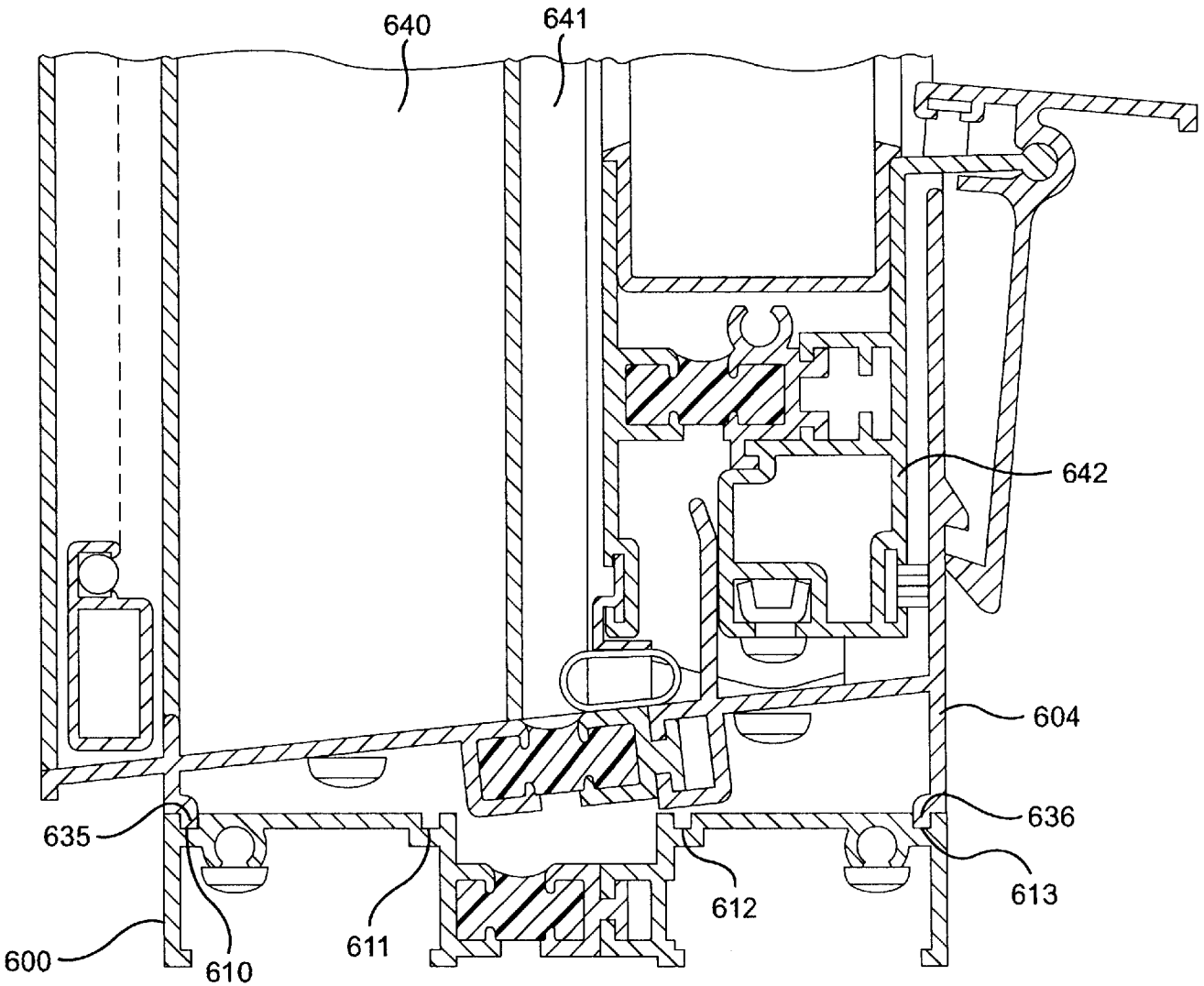
FIG. 14 is a cross-section view along line M of FIG. 11.

Further, and as shown in FIG. 14, the present frame may also be fitted with a frame-to-sash bracket 604 for a double-hung window. The frame 600 shown in FIG. 14 is the lower horizontal member, as opposed to the vertical members shown in FIGS. 11–13. The double-hung frame-to-sash bracket 604, as shown in FIG. 14, engages the grooves 610, 613 in the first and second bracket receiver structures by projecting rib sections 635 and 636. This engagement of the ribs 63and 636 within their respective groove sections secures the frame-to-sash bracket within the opening.

As with typical double-hung windows, the frame-to-sash double-hung bracket 604 shown includes two separate channels 640 and 641, each of which are dimensioned to accept the sash 642 of a double-hung window (only the bottom sash of the double-hung combination is shown). Each of these channels 640, 641 are dimensioned to allow each double-hung sash to move up and down within the frame-to-sash bracket, thereby enabling the window sash to move between an open and a closed position. As with the inswing and outswing windows described above, the double-hung window, when in the closed position, seals against the frame-to-sash bracket.

Figure 15:
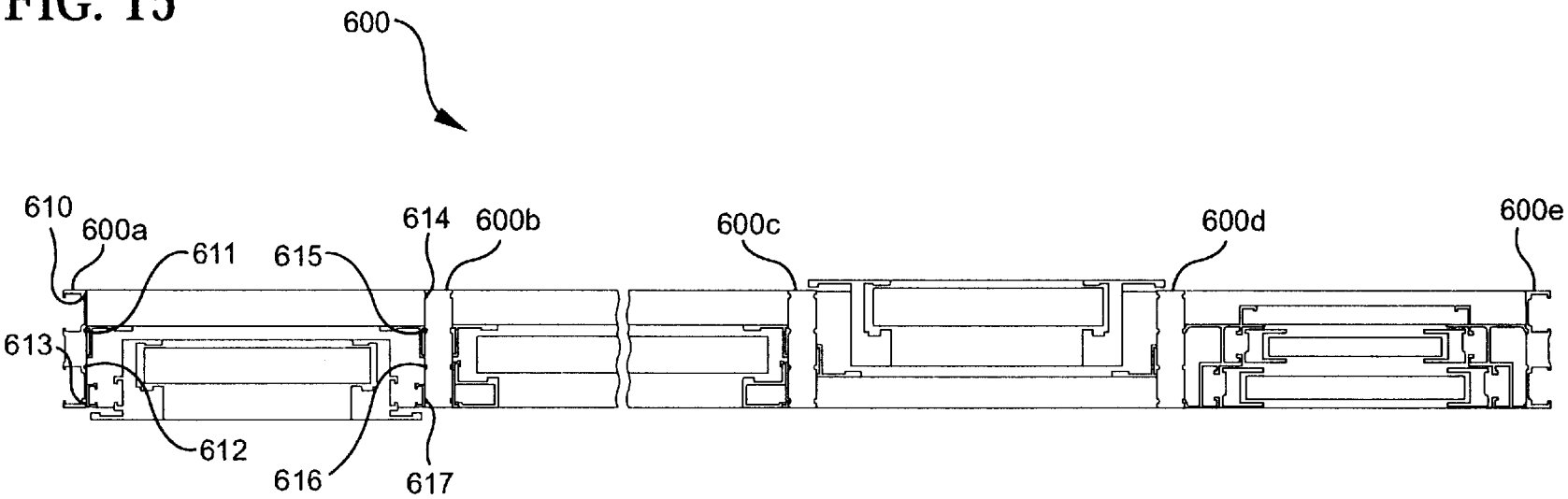
FIG. 15 is a cross-sectional view of a further embodiment of the frame of the present invention.

A further advantage of the present invention is that the opposed pairs of longitudinal grooves allows for the interchangeability of windows having varying depths. As shown in FIG. 15, a thinner window, be it an inswing, outswing, fixed or double-hung, can be secured within the frame of the present invention by securing the frame-to-sash brackets in a different groove within of each bracket receiver structure. For example, if a thinner inswing window sash 601 a is preferred, then rib 630 of L-shaped bracket 620 can be positioned within groove 611, as opposed to groove 610 described above. As can be seen from the remainder of FIG. 15, this arrangement works for all window types, i.e., inswing, outswing, fixed or double hung. This versatility of the aforementioned structure enables one to select the desired window type and window thickness. Further, if one does not like the window selection chosen, the replacement or swapping of these windows within the present frame is easily accomplished from either the inside or outside of the building.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A frame for a sash moveable between an open and a closed position, the frame comprising:

a first jamb;

a first bracket receiver structure integral with said first jamb;

a second bracket receiver structure integral with said first jamb;

a second jamb opposite said first jamb;

a third bracket receiver structure integral with said second jamb and opposed to said first bracket receiver structure;

a fourth bracket receiver structure integral with said second jamb and opposed to said second bracket receiver structure; and at least one frame-to-sash bracket configured to be removably secured to at least one of said first bracket receiver, said second bracket receiver, said third bracket receiver and said fourth bracket receiver;

wherein said frame-to-sash bracket is adapted to allow movement of the sash between the open and the closed positions.

2. A frame as described in claim 1 wherein said frame-to-sash bracket is a double-hung window bracket.

3. A frame as described in claim 2 wherein said double-hung window bracket includes two separate channels, each of said separate channels dimensioned to accept a sash of a double-hung window.

4. A frame as described in claim 1 wherein said frame-to-sash bracket includes a first L-shaped frame-to-sash bracket and a second L-shaped frame-to-sash bracket, said first frame-to-sash bracket and said second frame-to-sash bracket being removably secured within opposed bracket receiver structures.

5. A frame as described in claim 4 further including:

an inswing sash within the frame; and wherein said first frame-to-sash bracket is removably secured within said first bracket receiver structure and said second frame-to-sash bracket is removably secured within said third bracket receiver structure so as to allow said sash to swing in with respect to the frame.

6. A frame as described in claim 4 further including:

an outswing sash within the frame; and wherein said first frame-to-sash bracket is removably secured within said second bracket receiver structure and said second frame-to-sash bracket is removably secured within said fourth bracket receiver structure so as to allow said sash to swing out with respect to the frame.

7. A frame as described in claim 1 wherein said first, second, third and fourth bracket receiver structures are C-shaped receiver structures.

8. A frame as described in claim 1 wherein said first, second, third and fourth bracket receiver structures each include a pair of longitudinal grooves.

9. A frame for a sash moveable between an open and a closed position, the frame comprising:

a bracket receiver structure including a first bracket receiver, a second bracket receiver, a third bracket receiver opposed to said first bracket receiver, and a fourth bracket receiver opposed to said second bracket receiver; and a frame-to-sash bracket removably secured to said bracket receiver structure, said frame-to-sash bracket adapted to enable the sash to move between the open and the closed position when said frame-to-sash bracket is secured within said bracket receiver structure.

10. A frame as described in claim 9 wherein said frame-to-sash bracket is a double-hung window bracket.

11. A frame as described in claim 10 wherein said double-hung window bracket includes two separate channels, each of said separate channels dimensioned to accept a sash of a double-hung window.

12. A frame as described in claim 9 wherein said frame-to-sash bracket includes a first L-shaped frame-to-sash bracket and a second L-shaped frame-to-sash bracket, said first frame-to-sash bracket and said second frame-to-sash bracket being removably secured within opposed bracket receiver structures.

13. A frame as described in claim 12 further including:

an inswing sash within the frame; and wherein said first frame-to-sash bracket is removably secured within said first bracket receiver structure and said second frame-to-sash bracket is removably secured within said third bracket receiver structure so as to allow said sash to swing in with respect to the frame.

14. A frame as described in claim 12 further including:

an outswing sash within the window frame; and wherein said first frame-to-sash bracket is removably secured within said second bracket receiver structure and said second frame-to-sash bracket is removably secured within said fourth bracket receiver structure so as to allow said sash to swing out with respect to the frame.

15. A frame as described in claim 9 wherein said bracket receiver structure includes two pairs of opposed C-shaped bracket receivers.

16. A frame as described in claim 9 wherein said bracket receiver structure includes two pairs of opposed longitudinal grooves.

* * * * *